US005435551A

United States Patent [19]

Chen

[11] Patent Number: 5,435,551

[45] Date of Patent: Jul. 25, 1995

[54] GOLF CLUB HEAD OF COMPOSITE MATERIAL

[76] Inventor: Archer C. C. Chen, No. 501, 28 Rood, Industrial Dist, Hsi Tun Dist, Taichung, Taiwan

[21] Appl. No.: 346,174

[22] Filed: Nov. 22, 1994

[51] Int. Cl.[6] ..... A63B 53/02

[52] U.S. Cl. ..... 273/80.3; 273/80 C; 273/167 G

[58] Field of Search ..... 273/80.1, 80.2, 80.3, 273/80.4, 80.5, 80.6, 80.7, 80.9, 167 R, 167 A, 167 F, 169, 173, 174, 79, 80 C, 167 G, 78, 80 R

[56] References Cited

U.S. PATENT DOCUMENTS

| | | | |
|---|---|---|---|
| 1,222,770 | 4/1917 | Kaye | 273/80.2 |
| 1,594,850 | 8/1926 | Perkins | 273/79 |
| 1,602,567 | 10/1926 | Colwell | 273/78 |
| 1,768,792 | 7/1930 | Schavoir | 273/78 |
| 1,867,103 | 7/1932 | Schavoir | 273/78 |
| 1,983,158 | 12/1934 | Young | 273/80.4 |
| 2,346,617 | 4/1944 | Schaffer | 273/173 |
| 3,305,235 | 2/1967 | Williams | 273/79 |
| 4,728,105 | 3/1988 | Kobayashi | 273/173 |
| 4,927,144 | 5/1990 | Stormon | 273/80.2 |
| 4,988,104 | 1/1991 | Shiotani | 273/167 H |
| 5,269,517 | 12/1993 | Petrucelli | 273/80.3 |

FOREIGN PATENT DOCUMENTS

| | | | |
|---|---|---|---|
| 2094 | 3/1932 | Australia | 273/80.2 |

*Primary Examiner*—Sebastiano Passaniti
*Attorney, Agent, or Firm*—Browdy and Neimark

[57] ABSTRACT

A golf club head of a composite material comprises a metal body having a sole plate, a rod member, and at least two connection members. The rod member is disposed on the sole plate and is provided at one end thereof with a neck extending upwardly and obliquely therefrom. The rod member is fastened to the sole plate by the two connection members such that there are gaps between the rod member and the two connection members. The gaps are filled with a shell of a composite material upon completion of the molding process.

6 Claims, 3 Drawing Sheets

GOLF CLUB HEAD OF COMPOSITE MATERIAL

FIELD OF THE INVENTION

The present invention relates generally to a golf club, and more particularly to a golf club head of a composite material.

BACKGROUND OF THE INVENTION

As shown in FIGS. 1 and 2, a conventional iron golf club head 10 is placed flatly on the ground such that the shaft 11 and the horizontal ground surface form an angle called a lie 12, and that the face 13 and the plummet form an angle called a loft 14. The head 10 is fastened with the shaft 11 by means of a neck 15. As a result, the correctness of the lie 12 and the loft 14 is dependent on the angle of the neck 15.

A prior art golf club head 20 of a composite material is shown in FIG. 3 and is composed of a metal body 21 made by dewaxing and casting and provided with a sole 211 and a neck 212 extending from one end of the sole 211. The sole 211 is covered with a shell 22 of a composite material. The dewaxing and the casting of the metal body 21 often result in the shrinkage of the neck 212 of the metal body. As a result, the neck 212 has an incorrect angle, which must be corrected tediously by an instrument.

In addition, the golf clubs are numbered on the basis of the sizes of the lie and the loft. As a result, it is necessary to set up one wax mold for each number of the golf club head to facilitate the manufacture of the metal body having a specific neck angle.

SUMMARY OF THE INVENTION

It is therefore the primary objective of the present invention to provide an improved golf club head of a composite material, which can be so made as to have various numbers by the same metal element.

It is another objective of the present invention to provide an improved golf club head with a metal body neck having a correct angle.

The foregoing objectives of the present invention are attained by a gold club head of a composite material, which comprises a metal body having a sole plate, a rod member, and at least two connection members. The rod member is disposed on the sole plate and is provided at one end thereof with a neck extending upwardly and obliquely therefrom. The rod member is fastened to the sole plate by the two connection members such that there are gaps between the rod member and the two connection members. The gaps are filled with a shell of a composite material upon completion of the molding process.

DETAILED DESCRIPTION OF THE INVENTION

Figure 1:
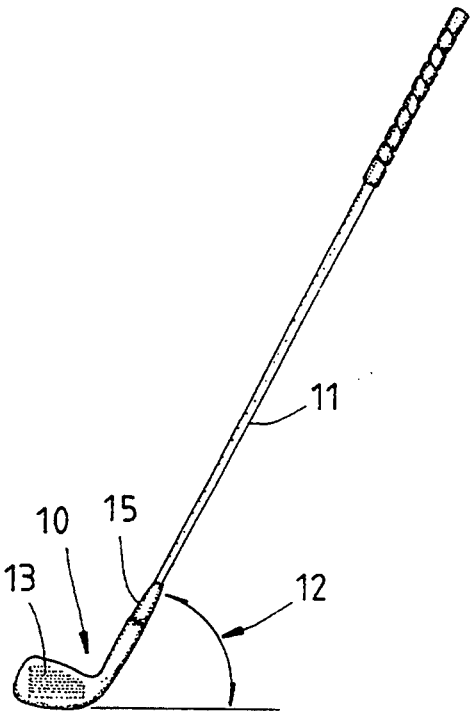
FIG. 1 PRIOR ART
FIG. 1 shows a front view of an iron golf club of the prior art.
Figure 2:
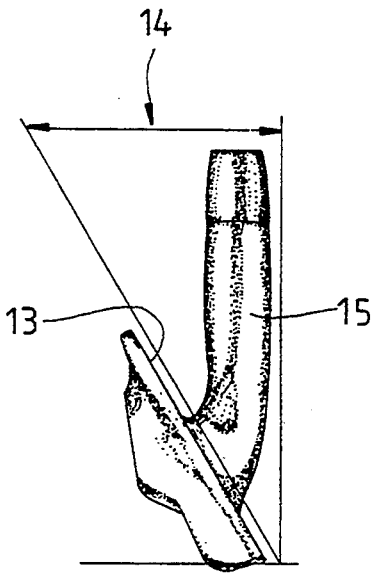
FIG. 2 PRIOR ART
FIG. 2 shows a side view of a head of the iron golf club of the prior art.
Figure 3:
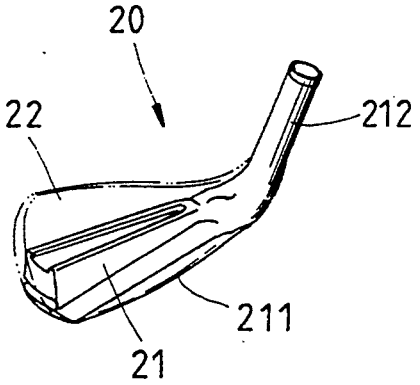
FIG. 3 PRIOR ART
FIG. 3 shows a schematic view of the construction of a prior art golf club head of a composite material.
Figure 4:
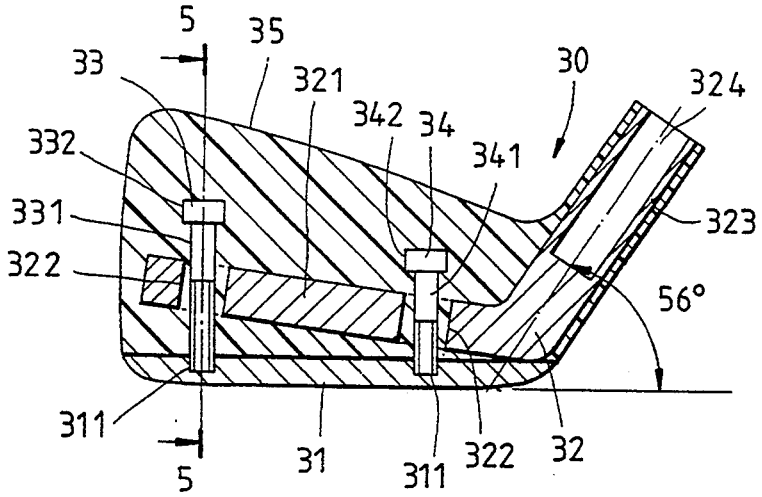
FIG. 4 shows a schematic view of the construction of a first preferred embodiment of the present invention.
Figure 5:
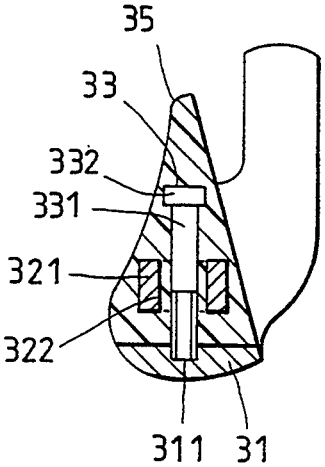
FIG. 5 shows a sectional view of a portion taken along the line 5—5 as shown in FIG. 4.

As shown in FIGS. 4 and 5, a golf club head 30 of the first preferred embodiment of the present invention comprises the component parts which are described hereinafter.

A sole plate 31 of a metal material has a predetermined weight and a sole similar in shape to the head 30. The sole plate 31 is provided in the upper surface thereof with two fastening holes 311.

A rod member 32 of a metal material has a straight body 321, which is disposed on the sole plate 31. The rod member 32 is provided with two through holes 322 corresponding in location to the two fastening holes 311 of the sole plate 31. The rod member 32 is further provided with a neck 323 extending upwardly and obliquely from one end of the body 321. The neck 323 is provided at the top thereof with an axial hole 324 for fastening with a shaft (not shown in the drawing).

Two connection members 33 and 34 are of a metal material and provided respectively with bodies 331 and 341, and with heads 332 and 342. The bodies 331 and 341 of two connection members 33 and 34 are fastened respectively to the two fastening holes 311 of the sole plate 31 via the two through hole 322 of the body 321 of the rod member 32. The two through holes 322 have an inner diameter greater than the outer diameter of the bodies 331 and 341 of the connection members 33 and 34. As a result, there is a room for upward, downward, leftward and rightward displacements between the body 321 of the rod member 32 and the sole plate 31.

A shell 35 of a fiber-reinforced resin material is disposed on the sole plate 31 such that the body 321 of the rod member 32 and the two connection members 33 and 34 are covered by the shell 35, and that the gaps between the body 321 of the rod member 32 and the connection members 33 and 34 are filled with the shell 35.

The sole plate 31 and the rod member 32 may be made by either dewaxing-casting or forging. According to the first preferred embodiment of the present invention, the sole plate 31 and the rod member 32 are made by forging for accelerating the production rate and improving the precision of the sole plate 31 and the rod member 32.

Fastened to the face of the club head of the shell 35 is a ball-hitting plate of a titanium material, a stainless steel material, a ceramic material, a copper material, or a composite material.

The shell 35 may be made of a plastic material, such as a P.P.S. plastic material, by injection molding.

The connection members 33 and 34 are of a nail-shaped construction. The bodies 331 and 341 of the connection members 33 and 34 may be provided with threads. The heads 332 and 342 of the connection members 33 and 34 have an outer diameter, which is preferably greater than the inner diameter of the through holes 322 of the body 321 of the rod member 32.

The metal bodies and the shell of the composite material are fastened together securely unless the composite material located between the connection members 33, 34 and the through holes 322 of the body 321 of the rod member 32 is crushed.

Figure 6:
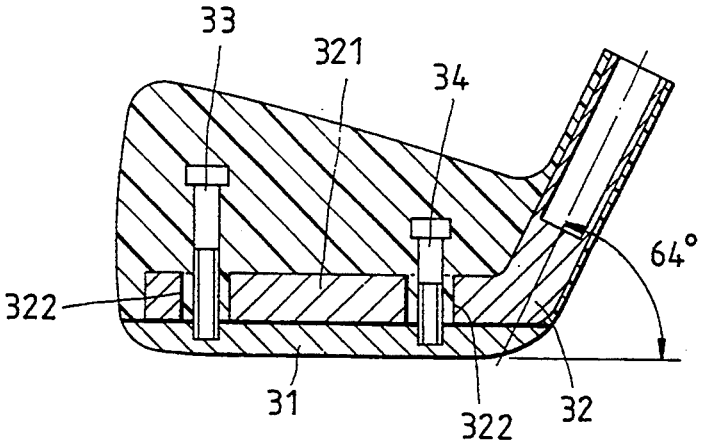
FIG. 6 shows another schematic view of the construction of the first preferred embodiment of the present invention.

As shown in FIG. 6, the production of the variously numbered golf club heads requires that the neck 323 of the rod member 32 is clamped by the head molding tool so as to set up a predetermined angle of the neck. Since there is a considerable adjusting gap located between the rod member 32 and the sole plate 31, the production of the variously numbered heads is possible by means of the rod member and the sole plate of the same type, in conjunction with the various weights and the head molding tools. The number of the iron golf club head shown in FIG. 6 is 9, with the lie of the iron golf club head being 64 degrees. The number of the iron golf club head shown in FIG. 4 is 1, with the lie of the iron golf club head being 56 degrees.

Figure 7:
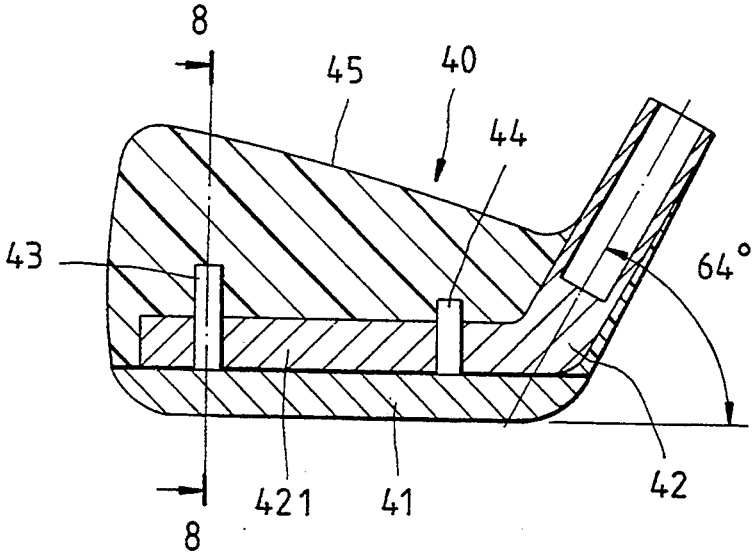
FIG. 7 shows a schematic view of the construction of a second preferred embodiment of the present invention.
Figure 8:
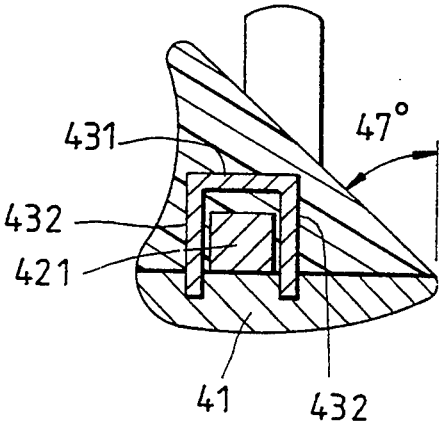
FIG. 8 shows a sectional view of a portion taken along the line 8—8 as shown in FIG. 7.

As shown in FIGS. 7 and 8, a golf club head 40 of the second preferred embodiment of the present invention comprises a sole plate 41, a rod member 42, two connection members 43, 44, and a shell 45 of a composite material. The head 40 of the second preferred embodiment is different from the head 30 of the first preferred embodiment in that the former is provided with the connection member 43 having a body 431 with two arms 432 extending in the same direction from both ends of the body 431, and that the connection member 43 is fastened to the sole plate 41 by means of the two arms 432 so as to form a through hole in which the body 421 of the rod member 42 is disposed. The connection member 44 is similar in shape to the connection member 43.

The connection members 33 and 34 of the first preferred embodiment and the connection members 43 and 44 of the second preferred embodiment may be of different sizes, depending on the need of the angular adjustment of the rod members 32, 42. For example, the connection members 34, 44 located contiguously at the neck ends should be respectively smaller than the connection members 33, 43 which are located respectively far away from the necks.

The principles of the two embodiments of the present invention described above may be applied to the iron club, the wooden club, the putter, the pitching wedge, and so forth.

What is claimed is:

1. A golf club head of a composite material comprising:

a metal body having a bottom and a neck for fastening thereto a shaft of a golf club; and a shell of a composite material and disposed on an upper surface of said bottom of said metal body;

wherein said metal body comprises:

a sole plate;

a rod member having a body which is disposed on said sole plate, said rod member further having a neck extending upwardly and obliquely from one end of said body;

at least two connection members fastened to said sole plate and connecting said rod member with said sole plate such that there are gaps of a predetermined dimension between said connection members and said body of said rod member, and such that a portion between said body of said rod member and said sole plate can be displaced upwards, downwards, leftwards and rightwards; and said shell filling said gaps of said metal body upon completion of molding.

2. The golf club head of a composite material according to claim 1 wherein said body of said rod member is provided along the direction of a longitudinal axis thereof with two through holes; and wherein said two connection members have a body and a head with an outer diameter greater than an outer diameter of said body of said connection members, with said two connection members being fastened to said sole plate such that said body of each said connection members is received in said through hole of said body of said rod member.

3. The golf club head of a composite material according to claim 2 wherein each of said connection members is of bolt construction.

4. The golf club head of a composite material according to claim 2 wherein said outer diameter of said head of said connection member is greater than an inner diameter of said through holes of said body of said rod member.

5. The golf club head of a composite material according to claim 1 wherein said connection members have a body and two arms extending in the same direction from said one end toward an opposite end of said body, with said two arms being fastened to said sole plate to form a through hole in which said body of said rod member is disposed.

6. The golf club head of a composite material according to claim 1 wherein said shell has a golf club head face to which a ball-hitting plate is fastened.

* * * * *